US006494665B1

(12) United States Patent
Bingman

(10) Patent No.: US 6,494,665 B1
(45) Date of Patent: Dec. 17, 2002

(54) CONTAINER DUMPING APPARATUS FOR REFUSE COLLECTION VEHICLE

(75) Inventor: John W. Bingman, Blanchard, OK (US)

(73) Assignee: Central Tank of Oklahoma, Norman, OK (US)

( * ) Notice: Subject to any disclaimer, the term of this patent is extended or adjusted under 35 U.S.C. 154(b) by 0 days.

(21) Appl. No.: 09/615,147

(22) Filed: Jul. 13, 2000

Related U.S. Application Data

(60) Provisional application No. 60/143,597, filed on Jul. 13, 1999.

(51) Int. Cl.[7] ..... B65F 3/08
(52) U.S. Cl. ..... 414/409
(58) Field of Search ..... 414/406, 409

(56) References Cited

U.S. PATENT DOCUMENTS

| | | | | |
|---|---|---|---|---|
| 4,313,707 A | * | 2/1982 | Bingman et al. | 414/409 |
| 4,597,710 A | * | 7/1986 | Kovats | 414/409 |
| 4,981,411 A | * | 1/1991 | Ramsey | 414/409 X |
| 6,071,058 A | * | 6/2000 | Tetz et al. | 414/409 |

FOREIGN PATENT DOCUMENTS

| | | | | |
|---|---|---|---|---|
| DK | 90315 | * | 1/1961 | 414/409 |
| EP | 420359 | * | 4/1991 | 414/409 |
| FI | 30443 | * | 12/1959 | 414/406 |
| GB | 2191461 | * | 12/1987 | 414/409 |

* cited by examiner

*Primary Examiner*—Steven A. Bratlie
(74) *Attorney, Agent, or Firm*—James F. Harvey, III

(57) ABSTRACT

An improved container dumping apparatus is described for automatically lifting residential refuse containers to an elevated position and dumping them into the elevated access area of a collection tank. A carriage with gripping arms is guided up the vertical portion of a set of tracks. The tracks transition into a curved portion at the top end which inverts the container over the access area through movement along the curved track. The carriage is self-powered by a hydraulic motor mounted on the carriage. The dumping apparatus uses an rack and pinion arrangement for forcibly elevating the carriage, with the rack being parallel to the set of tracks and the pinion mounted on the shaft of the motor on the carriage. A piston operated power assistance apparatus is located coincident with the curved portion of the track to engage the carriage as it approaches the curved portion, to provide additional power to aid movement of the carriage over the curved portion, and to control its speed.

18 Claims, 7 Drawing Sheets

CONTAINER DUMPING APPARATUS FOR REFUSE COLLECTION VEHICLE

CROSS-REFERENCES TO RELATED APPLICATIONS

This patent application claims priority based upon the following provisional patent application: No. 60/143,597, filed on Jul. 13, 1999, of the same or similar title.

BACKGROUND OF THE INVENTION

A. Field of the Invention

This invention relates generally to an improved refuse loader and more particularly to an apparatus for lifting, tilting, and emptying on-site trash containers into the access area for a compartment of a mobile collection vehicle.

Mobile collection systems for the picking up trash, refuse, or recyclable articles at numerous and separated sites are well known to the art. These systems consist of a vehicle traveling a standard route and standard containers designed to be automatically picked up on-site and dumped into the vehicle by an apparatus associated with the vehicle. These standard sized collection containers all have the same capacity but capacities differ from system to system, usually from approximately 50 to 300 gallons. In practice, the on-site containers are filled by the user and periodically the contents of the container are transferred to a mobile collection vehicle for transportation to a dump, land fill, or recycling center.

In order to provide a mechanism for efficiently emptying the on-site containers into the collection vehicle, various devices can be found in the prior art. These devices generally incorporate a vertical mast or boom which supports a means for grasping the container which is resting on a level surface, elevating the grasping means and grasped container to the top of the mast, dumping the container into an access opening in the top of the collection compartment, and returning the grasped container to its original position. Most of these devices also have a means for extending the vertical mast or boom a distance from the vehicle to accommodate the variable distance between the vehicle and the container.

B. Description of Prior Art

The prior art is replete with various devices for elevating and dumping the contents of a grasped container into a collection vehicle. These devices used to perform these two functions fall generally into two categories, those using chain drives and those using lever arms, either articulated or non-articulated.

U.S. Pat. No. 3,910,434, issued on Oct. 7, 1975, to Ebeling, is an example of the chain drive device. The invention employs a continuous linked chain driven by sprockets, or gears, mounted at the top and bottom of the mast, whereby the container grasping means, connected by links to the chain, and grasped container are carried to the top and then over a semicircular shaped mast head. The mast is connected by horizontal supports to the frame of the collection vehicle so that the entire apparatus can be extended away from the collection vehicle a short distance in order to provide more precise positioning to the container. A disadvantage of this device is that it has a large number of moving parts, so that the chains wear and frequently break from the stress of use.

The second type of device is illustrated by U.S. Pat. No. 4,427,333, issued on Jan. 24, 1984, to Ebeling, in which the chain drive mechanism is replaced with an articulated arm arrangement powered by a hydraulic cylinder and piston. A special linkage operating in conjunction with the articulated arm assembly and having four separate axes of rotation within its parts rotates an upper arm so as to swing the container grasping means and grasped container up along guide tracks to the top of the mast where the container was tipped and its contents dumped into a collection vehicle. From a pivot point at the top of the mast, the articulated arm lifts the container grasping means and grasped container the vertical distance of the mast. Like the chain drive device, the entire apparatus can be extended from the collection vehicle by various means mounted to the frame of the collection vehicle, whereby the device can be positioned more precisely with relation to the container. However, this device has several disadvantages as well. First, the height of the arms as they swing over the top of the collection vehicle can cause vertical clearance problems in tightly restricted areas. Second, the number of pieces comprising the linkage creates problems of manufacturability and cost. Third, the design itself tends to be heavy and cumbersome and does not lend itself to downsizing for smaller, residential loads which, because of their reduced weight and bulk, can be serviced with a lighter device having commensurate less expense to manufacture.

All such refuse loading devices share another common problem, namely, as the container grasping apparatus traverses over the top portion of the mast, more force is required to move the container grasping apparatus. For the linear portion of the mast, the force vector necessary to lift the apparatus only has a vertical component since it is overcoming gravity only. However, when the apparatus changes direction as it begins to traverse the curved portion of the mast, a horizontal component of force is required, so that the vector sum of the original vertical force component and the increasing horizontal force component is now greater in magnitude than the magnitude of the original force. Thus, more power is required as the apparatus traverses the curved portion of the mast.

The use of chains, pulleys, and cables employed in the elevation mechanism all increase the part count and thus provide more opportunity for failure of a part. A rack and pinion gear is commonly known in the mechanical arts, as for example in the steering mechanism of cars. Such rack and pinion arrangements can be used for lifting objects, as illustrated by U.S. Pat. No. 5,558,181, issued on Sep. 24, 1996, to Bundo. In this invention, an elevator is driven by a plurality of pinions carried on the elevator cage which engage a plurality of vertical racks secured to the sidewalls of the elevator passage. A primary feature of this device is the presence of a crown gear driven by a screw shaft connected to a motor mounted on the elevator cage, thus creating an irreversible driving device; this arrangement prevents the cage from falling in the event of a motor failure. However, this invention does not suggest or teach the use of a single rack and pinion for such purposes, and emphasizes the irreversible aspect to the invention as a safety device to provide passive braking.

What is needed therefore is an apparatus for elevating a trash container and inverting it over the elevated access area of a compartment that will accomplish the following objectives:

1. Reduced requirements for horizontal and vertical clearance so that it may be operated within narrow alleyways and driveways in residential areas;

2. Reduced number of parts to aid in manufacturability and reduce expense; and

3. Reduced number of moving parts to improve repairability.

4. Controlled traversal of the container grasping means as it traverses the curved part of the apparatus to reduce centrifugal force on the container and thus reduce strain on the apparatus.

SUMMARY OF THE INVENTION

It is therefore an object of the present invention to provide an improved apparatus for elevating a grasped container from a rest position on a level surface to an elevated position above the access area of a collection compartment and tipping the container so that the contents of the container falls by gravity into the access area.

Another object of the invention is to provide a method of controlling the speed of the container grasping apparatus as it traverses a curved portion of the elevating device which causes the container, along with the container grasping apparatus, to be inverted.

Another object of the invention is to provide a method of providing power to assist the container grasping apparatus as it traverses the curved portion of the elevating device which causes the container, along with the container grasping apparatus, to be inverted.

Another object of the invention is provide an improved means for mounting the invention to a trash collection vehicle.

Another object of the invention is to provide a means for mounting the invention to a trash collection vehicle in a location other than the under carriage so as to improve ground clearance for the vehicle which is so equipped.

Another object of the invention is to provide a trash elevation apparatus which has a reduced part count so as to aid in manufacturability, maintenance, and expense.

These objects of the invention are achieved by an apparatus consisting of an improved track assembly with a linear portion in a substantially vertical plane and with a curved portion at its upper end. The track assembly is supported by extendable, horizontal frame assembly at its upper end connected to the collection tank, and not connected at its lower end connected to the vehicle frame as heretofore. The improved track assembly supports and guides an improved carriage assembly having a self-contained motor which powers the carriage assembly vertically up and down the track assembly and arcuately over the curved top of the mast assembly. To assist movement of the carriage assembly over the curved portion of the track assembly and to control the speed at which the carriage moves over the curved portion, an improved dumping assembly is provided. It consists of a crank on one end of a rotatable tie bar for grasping trunions protruding from either side of the carriage assembly as the carriage assembly approaches the top of the vertical portion of the track assembly, and a piston connected to the opposing end of the tie bar through an arrangement of an articulated, pivotable yoke and offset mounts, whereby the carriage assembly is guided up and over the curved top portion of the track assembly by the crank, the container is upended, and its contents is dumped into the collection tank. The configuration of piston, yoke, and offset mount provides a unique means to, first, brake the momentum of the carriage assembly as it goes over the top of the track assembly and, second, to provide additional power to assist the movement of the carriage assembly as it transitions from a linear to an arcuate path. This configuration also does not extend beyond the confines of the track assembly and thus prevents clearance problems when the vehicle on which the apparatus is mounted travels through narrow streets and alleyways.

The method of moving the improved carriage assembly along the track assembly consists of a rack and pinion arrangement, whereby the rack extends the length of the mast and the pinion gear is mounted on the carriage assembly and self-powered by a motor within the carriage assembly. A pair of guide rails are provided on either side of the rack to hold the carriage assembly to the track assembly by means of wheels mounted on the carriage assembly and journeled into channels provided by the guide rails. This arrangement also maintains the pinion gear in close proximity to the rack so that the teeth of the rack and pinion mesh properly. The pinion gear also serves as a brake to prevent the carriage assembly from descending the track assembly when movement is arrested.

The vertical portion of the rack is a standard linear sheet of metal in which is stamped or formed a series of spaced ridges forming teeth. The curved rack portion of the rack consists of a unique arrangement of horizontal bars mounted between the guide rails and having the spacing which meshes the bars to the pinion gear. These bars allow the carriage to continue movement beyond the top portion of the track assembly and over the curved portion of the track assembly, by providing engagement points for the pinion gear in the carriage assembly. It is also believed that this arrangement aids manufacturability by removing the necessity of fabricating a curved rack portion from sheet metal which has a different spacing of teeth in the curved portion of the rack due to the rack's curvature. An additional advantage of this bar arrangement is that debris cannot build up on the curved portion of the rack but will fall between the bars.

A container grasping apparatus which is standard to the industry and commonly used is connected to the carriage assembly and powered by hydraulic means.

The manner in which the frame assembly is moved transversely is considered to be a unique and innovative part of the invention. A double piston arrangement is used to achieve movement and is powered by the same hydraulic system used to power the carriage assembly, the gripping assembly, and the power assistance assembly. The double piston arrangement is used in lieu of previous chain and sprocket mechanisms and/or nested channel arrangements, so as to achieve a more dependable, less breakage prone mechanism.

The improved trash handling apparatus thus described is believed to be more compact and lightweight than similar devices described heretofore, and improves manufacturability of the apparatus because of its reduced parts count and simplicity of construction.

BRIEF DESCRIPTION OF THE DRAWINGS

FIG. 9 shows a close-up detail view of the distal end of the frame assembly to illustrate how the pads are attached to the frame assembly to maintain alignment during movement.

DETAILED DESCRIPTION OF THE PREFERRED EMBODIMENTS

Figure 1:
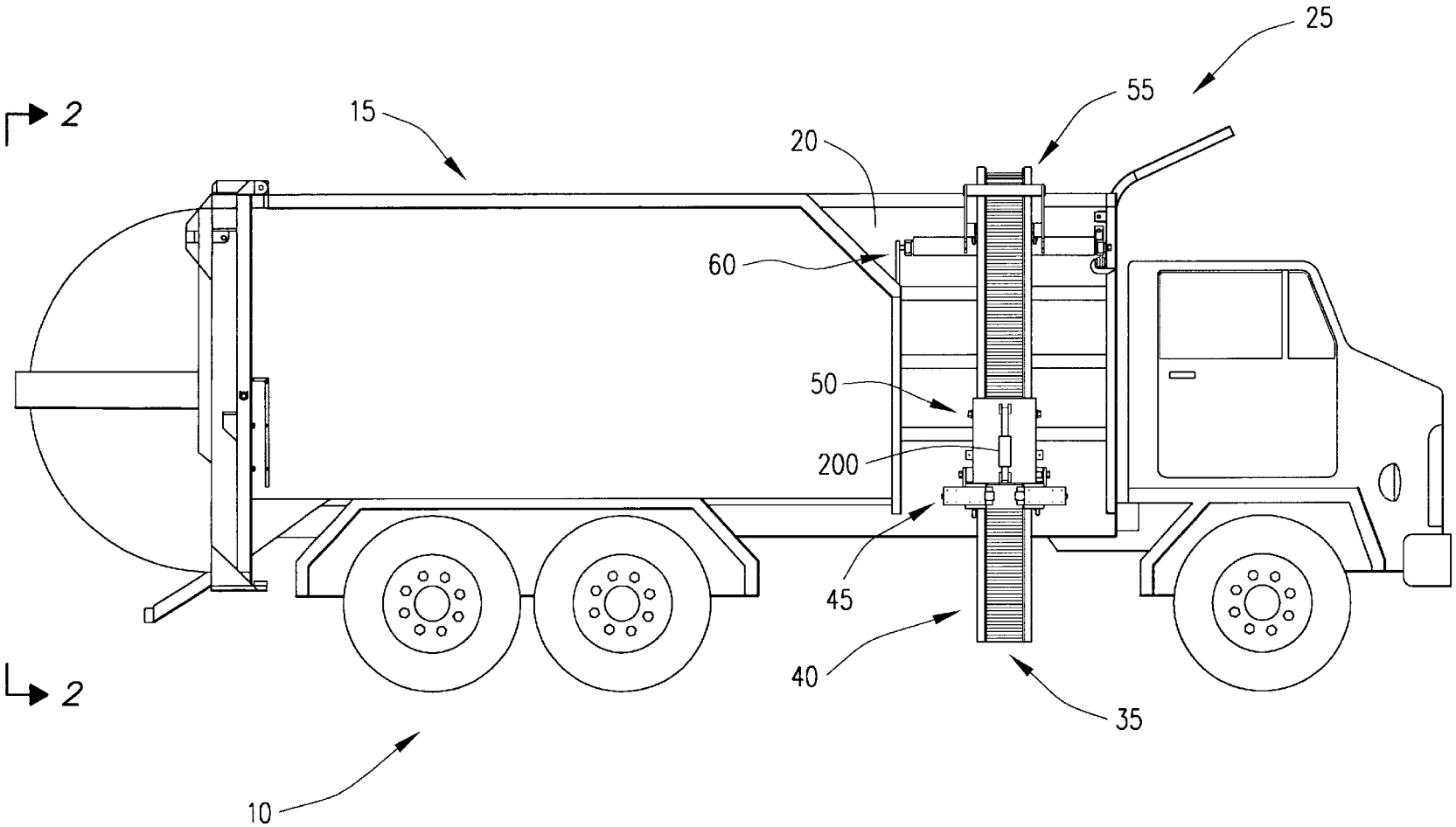
FIG. 1 shows a collection vehicle upon which the invention is mounted.

FIG. 1 illustrates a vehicle 10 on which a collection tank 15 is mounted. Collection tank 15 has a access area 20 near the front end 25 thereof for receiving trash, garbage, recyclables, or the like, and an end gate 30 for removal of the collection tank contents. A loader 35 for handling a container (not shown) is attached on one side of the collection vehicle 10, handling being more specifically defined as engaging, elevating, dumping, and returning the container to a desired location. In the illustrated embodiment, the loader 35 is mounted on the passenger side of the collection vehicle 10, but choice of passenger side or driver side is arbitrary. The loader 35 includes a track assembly 40, a gripping assembly 45, a carriage assembly 50, a power assistance assembly 55, and a frame assembly 60.

Figure 2:
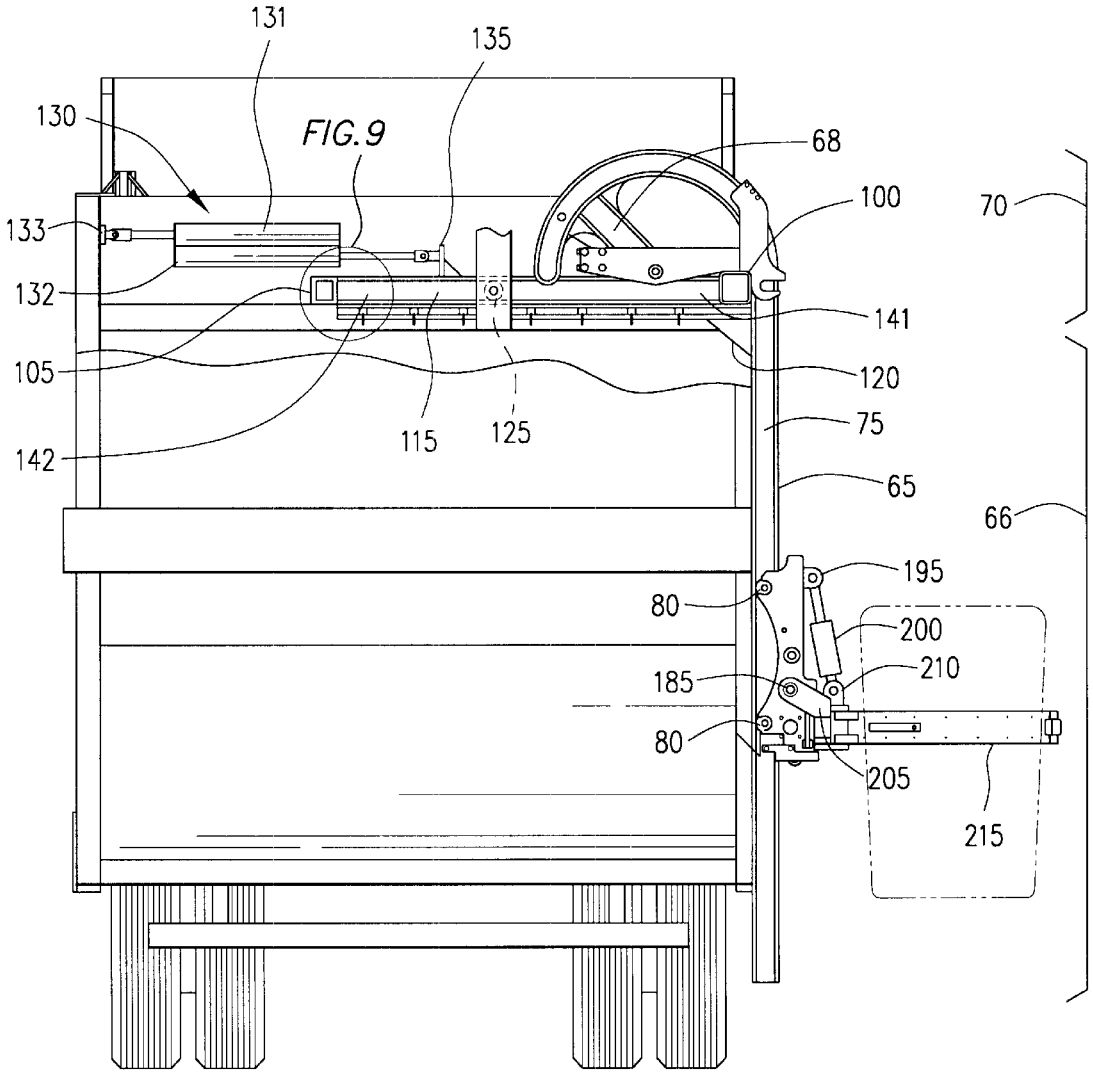
FIG. 2 depicts a rear view of collection vehicle and invention, with a cutaway portion so that the extension rail arrangement used in the invention may be seen, where the track assembly is horizontally extended from the collection vehicle to permit the container grasping means to engage a container (container not shown).
Figure 3:
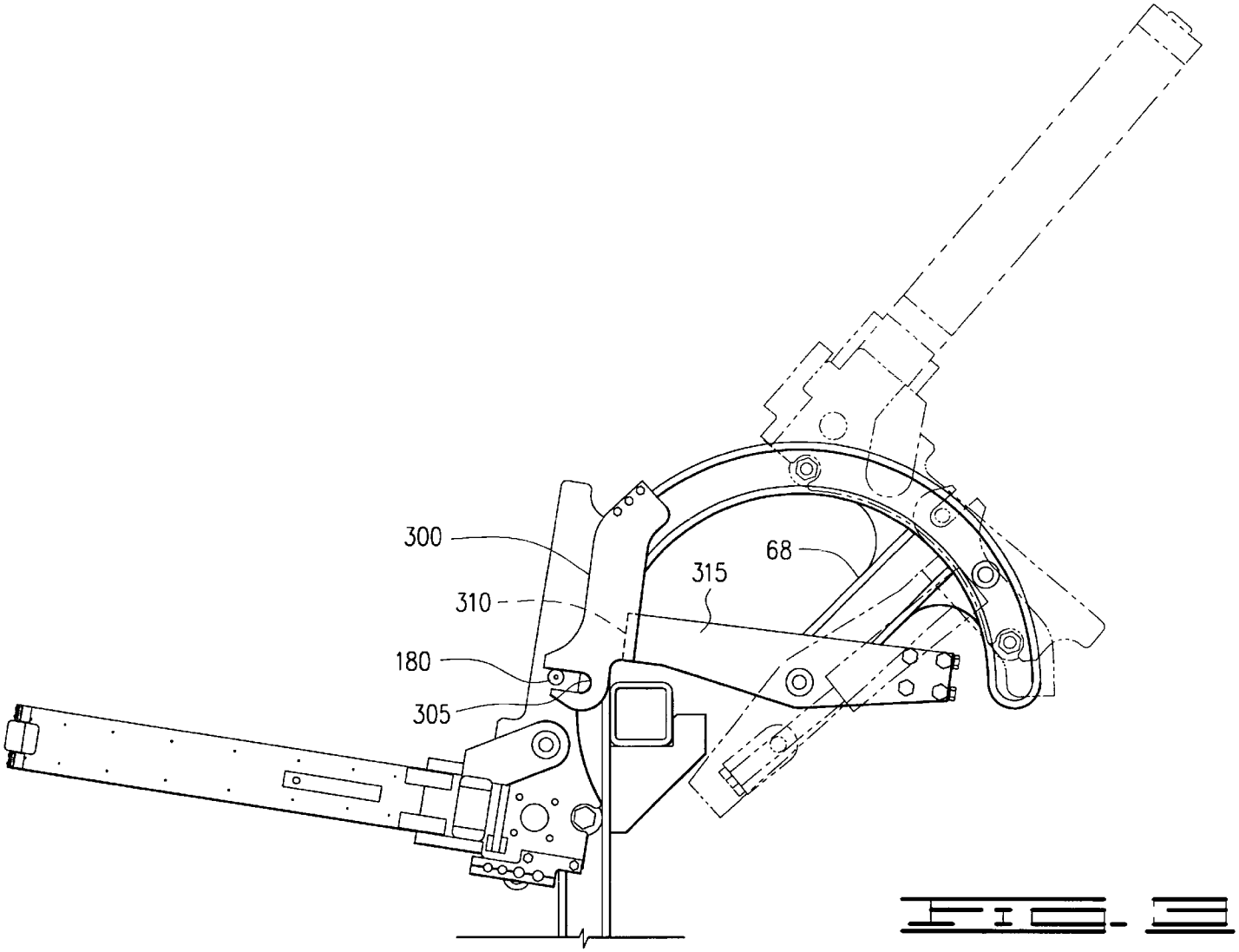
FIG. 3 shows a side view of the upper portion of the track assembly, on which the carriage assembly with gripping arms is depicted as it encounters the crank of the power assistance assembly while moving upwards, and the same carriage assembly with gripping arms is shown in phantom at its final tipped position.
Figure 6:
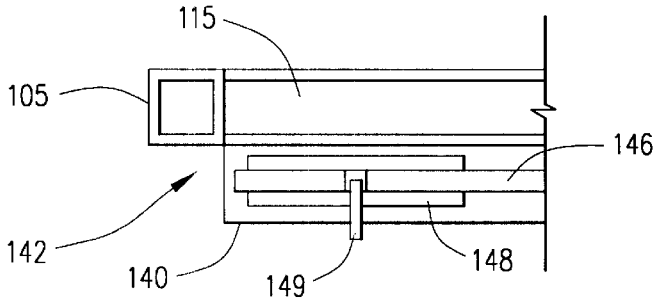
FIG. 6 shows a detailed side of the upper portion of the track assembly with one guide rail being removed to allow viewing of the power assistance assembly in more detail.
Figure 8:
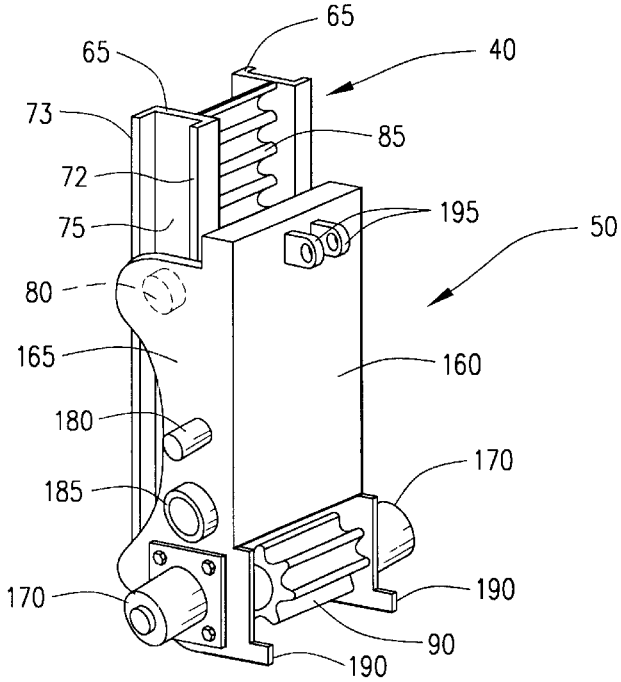
FIG. 8 shows a perspective view of the carriage assembly with the gripping assembly removed so that the pinion gear may be observed more easily.

Track assembly 40 is best seen by reference to FIGS. 2, 6, and 8. As can be seen in the figures, track assembly 40 includes two spaced apart guide rails 65, each having a linear portion 66 from the lower end of the guide rail 65 and a curved portion 70 spaced shaped as a semi-circle having center of curvature 610 and terminating in the proximity of the access area 20 of vehicle collection tank 15. The curved portion 70 of each guide rail 65 is rigidly supported by a horizontal brace 67 welded to the guide rail 65 and extending inwardly and by an angled brace 68 welded to guide rail 65 and extending inwardly, both of which meet at the center of curvature 600 of the curved portion 70. An inner flange 73 and an outer flange 72 are formed on edges of the guide rails 65 to form opposed, outwardly facing channels 75, which in turn receive rollers 80 associated with the carriage assembly 50. Rack 85 is interposed between guide rails 65 and set a constant distance from the outer surface of guide rails 65 along its length. Rack 85 may be constructed in a number of different ways. In its simplest form, rack 85 may be a corrugated piece of sheet metal with the corrugations formed so as to mesh with pinion gear 90 in carriage assembly 50, discussed later. It can also be more solidly constructed by welding a series of parallel bars to a planar piece of sheet steel or aluminum, spaced appropriately to form teeth of the rack 85. Teeth can also be formed by molding a gear-like surface on a metal substrate or by attaching appropriately formed teeth my standard means known to the industry, such as by welding, rivets, rearwardly inserted bolts, machining, press forming, and the like. Optionally, a series of stiffening members (not shown), such as rods, channel iron, box beams, and the like, can be inserted along the rear surface of rack 85 along the linear portion 66 of guide rails 65 and welded to the inner surfaces of guide rails 65 for additional structural support. Use of such stiffening members for supporting rack 85 as well as for maintaining a constant separation between guide rails 65 will permit a narrower rack and pinion gear combination to be used, since the rack would not necessarily be required to abut the inner sides of guide rails 65.

Figure 5:
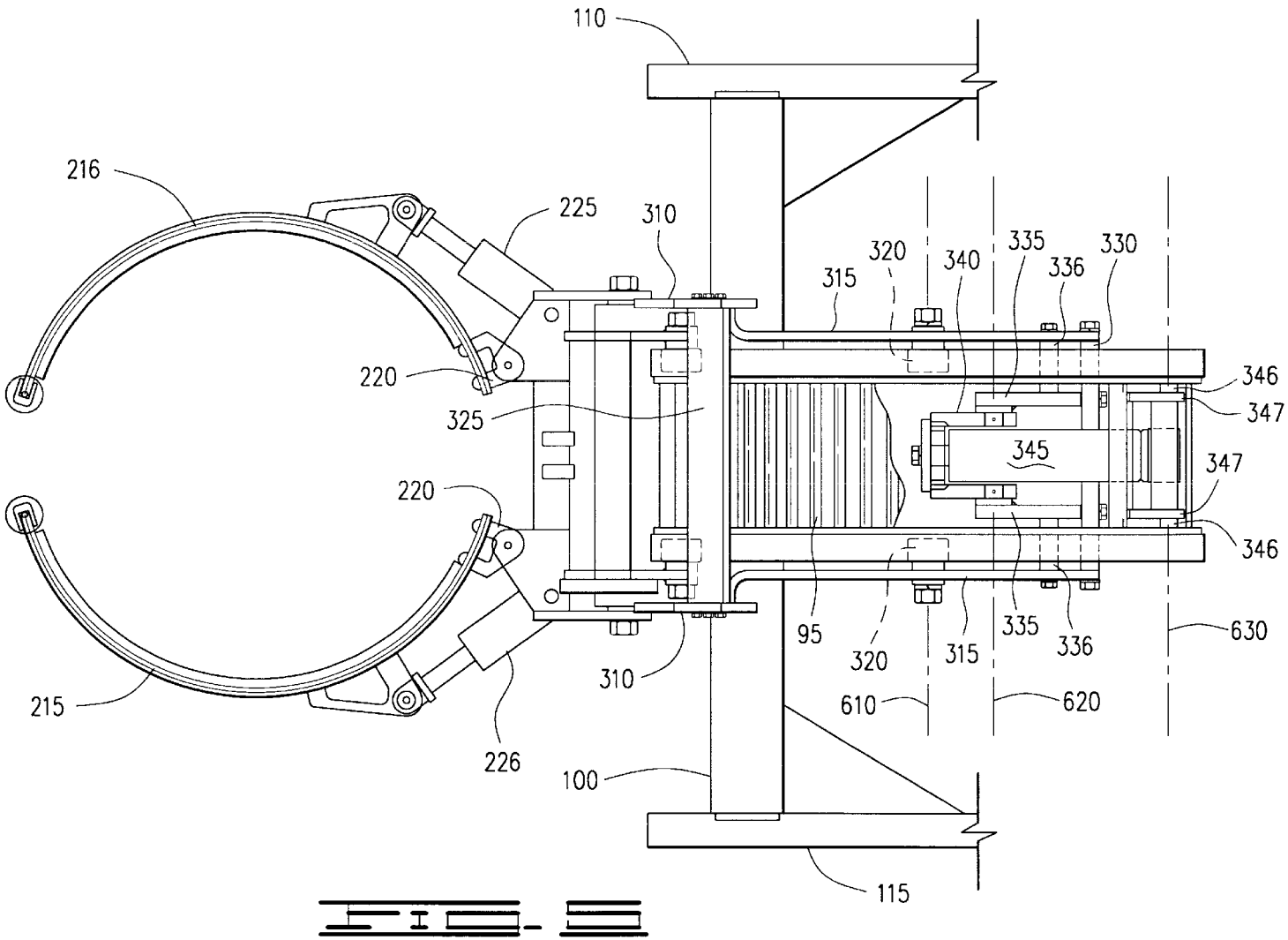
FIG. 5 shows a top view of the track assembly with the rack assembly being cut away to allow viewing of the power assistance assembly.
Figure 5:
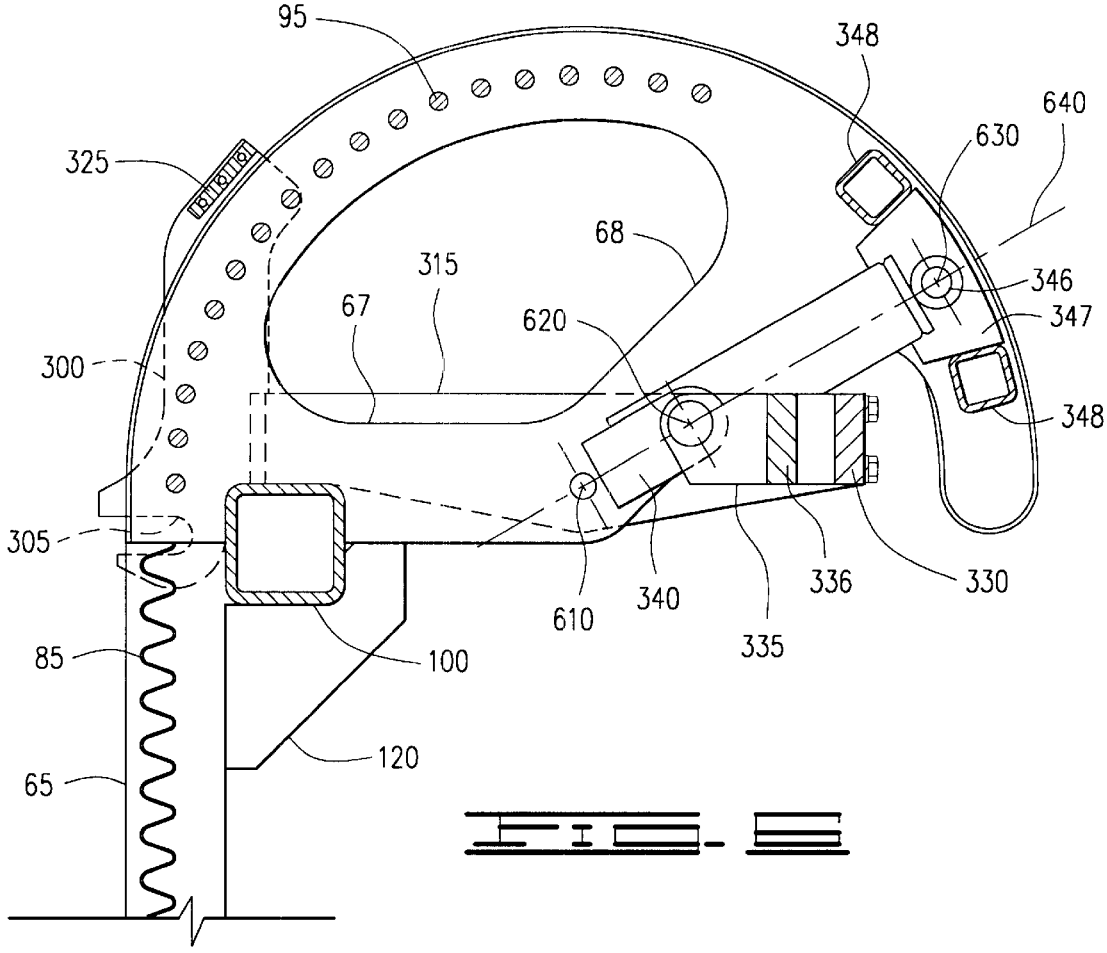

The rack assembly takes on a different form along the curved portion 70 of guide rails 65, as best seen in FIGS. 5 and 6. Horizontally oriented rack bars 95 are inset the same distance as the teeth on rack 85 and spaced along the circumference of curved portion 70, to allow the teeth of pinion gear 90 to mesh with rack bars 95. Use of such rack bars allows pinion gear 90, after leaving rack 85 when carriage assembly 50 traverses the curved portion 70 of guide rails 65, to properly mesh with rack 85 on the return traversal.

Figure 4:
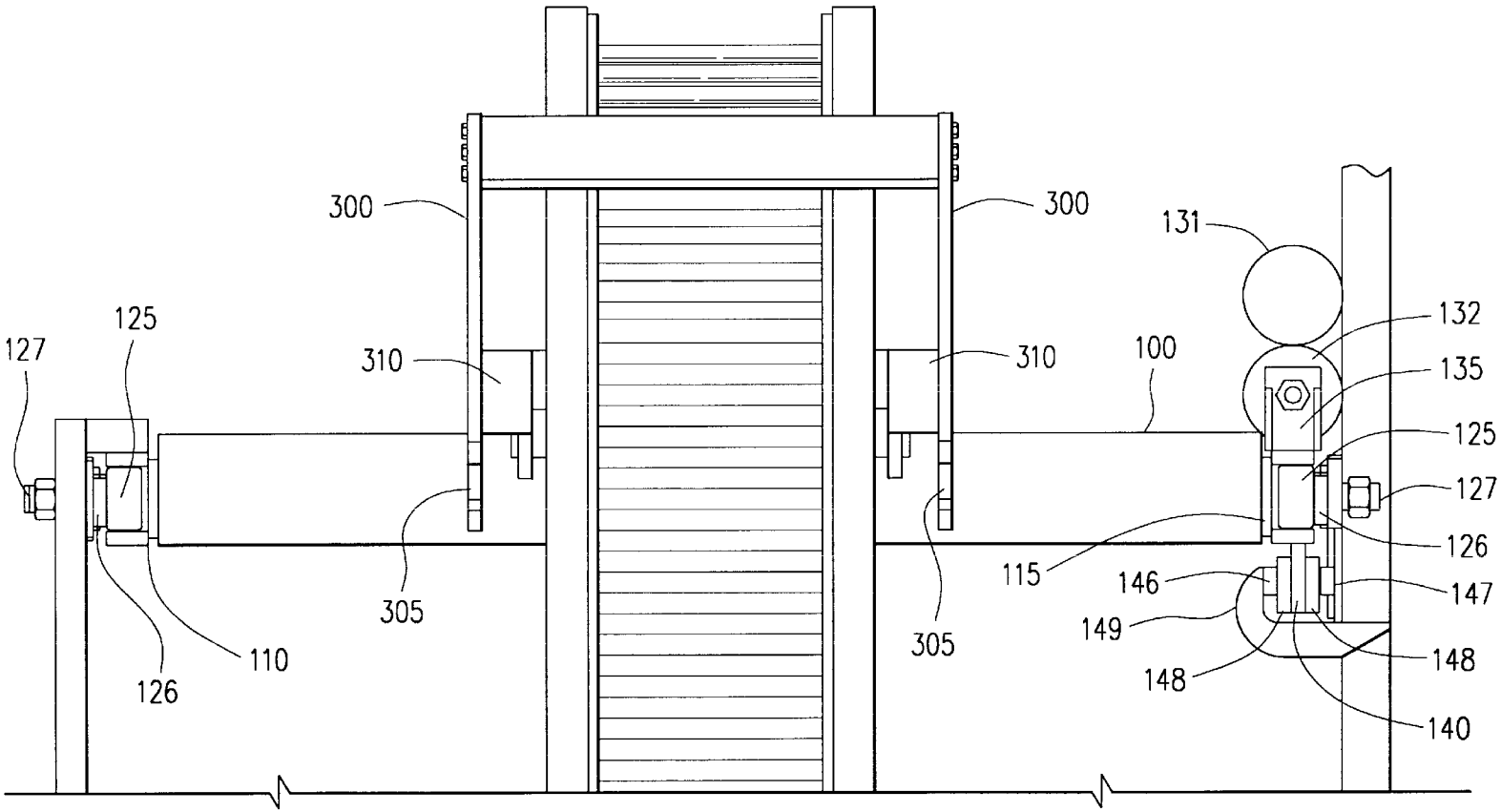
FIG. 4 shows a frontal view of the upper portion of the track assembly with the rack assembly cut away so that the yoke of the power assistance may be discerned and with the piston removed for clarification.

The frame assembly 60 is now described, with reference to FIGS. 2, 4,and 9. The frame assembly 60 serves as the sole point of support for the downwardly hanging track assembly and connects loader 35 to collection tank 15 at its topmost portion. The main frame structure is rectangular and comprised of main support member 100, inner support member 105, left channel member 110, and right channel member 115. Channel members 110, 115 run transverse the vehicle and are parallel with one another with channels outwardly oriented with relation to the interior of the rectangle so formed by members 100, 105, 110, 115. Track assembly 40 is carried by main support member 100 as by welding the guide rails 65 to the outwardly facing surface of main support member 100. Main gussets 120 are provided to connect guide rails 65 to main support member 100 by providing additional welding surface area and support. Channel members 110, 115 are each supported by two frame rollers 125, each roller being supported on a bearing 126 and axially mounted on a bolt 127. The location of the innermost two frame rollers 125 is shown best in FIG. 2. The outermost frame rollers 125 are not shown but are positioned generally at the outermost extent of the tank body. The placement of the rollers is not critical nor is their spacing along channel members 110, 115. Transverse movement of the frame assembly 60 is achieved by use of a double piston assembly 130, consisting of two opposed pistons 131, 132, the bodies of which are rigidly connected together as by welding. The piston rod of rear facing piston 131 is attached to bracket 133 on the wall of the tank body opposite loader 35, and the piston rod of forward facing piston 132 is connected to bracket 134 on right channel member 115. Transverse movement of frame assembly is achieved by simultaneous expansion and simultaneous contraction of pistons 131, 132 against one side of the rectangular frame. In order to ensure that the force applied against right support member 115 does not skew the member as against rollers 125 journeled therein, a fin 140 the same length as right channel member 115 is rigidly attached to the bottom flange comprising right channel member 115 as by welding. An outer guide bar 146 and an inner guide bar 147, each also having the same length as right channel member 115, are positioned parallel to and on either side of fin 140. Outer guide bar 146 is supported along its length by a number of rail brackets 149 spaced along its length and attached to the outer guide bar 146 as by welding. Inner guide bar 147 is similarly supported, either directly on a wall of the collection tank or by suitable brackets (not shown). Two pads 148 composed of a suitable resilient material, such as plastic, are interposed between the fin 140 and the respective guide bars 146, 147 at the distal end 142 of right channel member 115, so that the distal end 142 is kept in alignment with the proximal end 141 as force is applied to move frame assembly 60.

Figure 7:
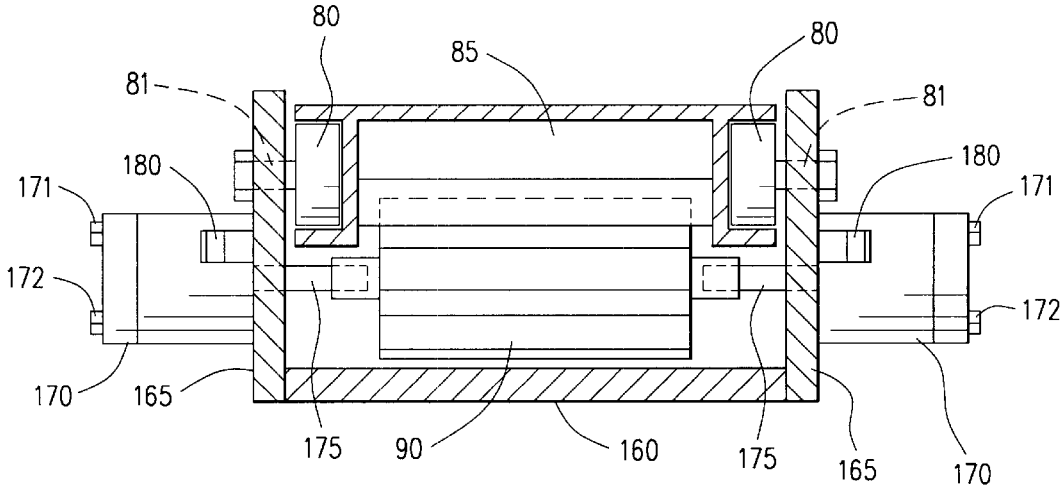
FIG. 7 shows top view of the carriage assembly with the top panel cut away.

The carriage assembly 50 is best described with reference to FIGS. 7 and 8. The gripping assembly 45 is mounted to the carriage assembly 50 for movement along the length of the track assembly 40 by means of a roller connection to each of the guide rails 40, as best seen in FIGS. 7 and 8. Carriage assembly 50 is formed of a structure having a front panel 160 with sufficient width to span the track assembly 40 and two side panels 165, each side panel 165 having an inwardly directed shaft 81 at its uppermost end and an inwardly directed shaft 81 at its lowermost end. An inwardly directed roller 80 is journaled on each of the several shafts 81. The outermost side of each guide rail 65 has an inturned outer flange 72 and an inturned inner flange 73 which form a channel 75 to guide the rollers 80 of the carriage assembly 50 as it traverses the track assembly 40. A horizontally oriented pinion gear 90 is contained in the carriage assembly 50 so that the pinion gear 90 meshes with rack 85. Each end of the axis of pinion gear 90 is connected to the rotating shaft 175 of a hydraulic motor 170. Although a single motor of electrical or hydraulic configuration may be used, the described embodiment has been found to have superior balance and power characteristics and is considered to be the best mode for powering carriage assembly 50. Each hydraulic motor has a supply fitting 171 and a return fitting 172 for supplying hydraulic fluid to the motor for powering it; the method of controlling the motors is well known to the art and not described here. A pair of trunions 180 horizontally extend from approximately the middle of carriage side panels 165, the trunions 180 for detachable engagement with a pair of cranks as described later. A pair of outwardly directed rings 185 are provided to serve as a horizontal axis about which the gripping assembly rotates upwardly. A pair of support tabs 190 are also provided to serve as supports for the gripping assembly 45. A pair of upper mounting lugs 195 are provided as points of attachment the vertical control piston 200 (FIG. 2) associated with the gripping assembly 45. The upper mounting lugs 195 have opposed holes suitable for insertion of a retaining pin (not shown) which captures an end of the vertical control piston 200.

Another embodiment of the drive mechanism of the carriage assembly 50 is the use of a gear box employing a worm gear driving a crown gear arrangement interposed between the shaft 175 of the motor 170 and the axis of the pinion gear 90 (not shown in figures). Such an arrangement would provide an additional safety feature for the carriage assembly 50, such that, in the event of a motor failure, gravity would not cause the carriage assembly to forcefully and rapidly fall to the bottom portion of the track assembly 40. The presence of a worm gear and crown gear arrangement would prevent gravitational force exerted on the carriage assembly from being transmitted back through the pinion gear to the motor, since the worm and crown gear arrangement is not reversible. However, this embodiment is not preferred for the application on trash collection vehicles; the presence of such a gear box would force a hydraulic motor run at high speeds in order to overcome the gear ration presented by the gear box and provide an acceptable speed of operation for the carriage assembly. Such an embodiment might be more acceptable for larger elevating applications in which the weight being moved would preclude rapid movement.

The gripping assembly 45 enables a container resting on a level surface to be securely grasped and held by the loader 35 for lifting, tilting, and emptying the container's contents into the access area 20 of collection tank 15. Referring to FIGS. 1, 2, and 5, the gripping assembly 45 is mounted on the carriage assembly 50 by means of two posts 205 having holes in their upper ends sufficient to accommodate rings 185 therein for upward tilting of the gripping assembly. This upward tilting is accomplished by vertical control piston 200 which is attached on its one end by lower mounting lugs 210 associated with the gripping assembly 45 and to upper mounting lugs 195 associated with the carriage assembly 50. Gripping assembly 45 includes a pair of oppositely disposed gripping arms 215 and 216, each having an inner surface which engages the exterior surface of a generally cylindrical container. Clearly, the configuration and shape of the gripping arms will vary depending upon the shape and size of the container used; in this embodiment, the arcuate shape of the gripping arms is suitable for cylindrical containers. The inner ends of each gripping arm 215, 216 terminate with a arm mounting bracket 220 having a vertical hole for pivotal attachment to the gripping assembly. Hydraulic actuators 225, 225 are attached between the gripping arms 215, 216 and the gripping assembly body so that the gripping arms may open and close with sufficient clearance to encircle and capture a container.

This general description of the gripping assembly is only indicative of many such devices well known to the art. One such gripping assembly is described in the aforesaid U.S. Pat. No. 3,910,434; another is described in the aforesaid U.S. Patent RE 34,292 (a reissue of U.S. Pat. No. 5,049,026, by Bingman et al.). The gripping assembly is not essential to the inventive concept and is included only for completeness.

The structure of the power assistance assembly can best be understood with reference to FIGS. 3, 4, 5, and 6. A crank 300 having a slot 305 for engagement with trunion 180 is connected to the curved end 310 of tip beam 315 which pivots about axis of rotation 610 common with the center of curvature of curved portion 70 of guide rail 65. The lower portion of crank 300 is notched to rest on the main support member 100 when at rest, and the curved end of tip beam 315 is similarly structured to rest on main support member 100. Tip beam 315 is positioned on the outer side of angled brace 68, horizontal brace 67, and guide rail 65, and is configured for rotation by mounting on a cam follower 320 which serves as a bearing. An identical arrangement of crank 310 and tip beam 315 assembly is configured for the other guide rail 65 and joined at the upper end of cranks 310 by a tie bar 325 passing over both guide rails 65. The non-curved ends of tip beams 315 are joined together by a tie plate 330, which passes interior to the curved portions 70 of guide rails 65 and below angled brace 68. Tie bar 325 and tie plate 330 maintain the pair of tip beams 315 and pair of cranks 310 in parallel alignment. Attached to tie plate 330 are two yoke supports 335 extending parallel to tip beams 315. Spacer blocks 336 parallel to tie plate 330 and spaced therefrom maintain alignment and provide structural support for yoke supports 335. Yoke 340 is pivotably interposed between the free ends of yoke supports 335 and rotates about axis of rotation 620. The bight of yoke 340 receives one end of power piston 345, the opposite end of which is pivotably disposed about a horizontal shaft 346 interposed between two vertical plates 347 which in turn are supported by two horizontal box beam piston supports 348 extending between the interior surfaces of the curved portion of guide rails 65. The power assistance assembly 55 is configured so that, when the tip beam 315 and crank 310 is resting on main support member 100, as depicted in FIG. 6, the axes of rotation for the tip beam 315, yoke 340, and power piston 630 are all aligned along centerline 640. Power piston 340 cannot be extended because of the alignment of axes.

All activities of the improved refuse collection system, to include (1) lateral extension of loader 35 from the vehicle 10, (2) reciprocal movement of the carriage assembly 50 on the track assembly 40, (3) grasping and releasing activity of the gripping assembly 45, and (4) assistance to movement of carriage assembly 50 over the curved portion 70 of the guide rails 65, are all accomplished by means of the same hydraulic control system. Such control systems are operable from the cab of vehicle 10 using standard ring and lever means. Design of an appropriate hydraulic system is considered to be well known to the industry and not presented here.

The operation of the apparatus will now be described. When vehicle 10 has been positioned adjacent to a container, the loader 35 is extended laterally to engage container with the container gripping arms 215, 216. As stated previously, this gripping operation may be effected with any suitable mechanism. In the illustrated embodiment, the track assembly 40 is extended laterally by expansion of double piston assembly 130 which urges the frame assembly 60 supporting track assembly 40 to move outwardly along rollers 125 and engagement with the container is effected. Subsequent retraction of the track assembly toward the vehicle is effected in order to bring the container into a correct final position adjacent to vehicle 10.

Elevation of the gripping assembly 45 along with the container is initiated by applying power to each of hydraulic motors 170 which cause pinion gear 90 to rotate and advance the carriage assembly 50, and consequently gripping assembly 45 with its held container, upwards along the rack 85. As the carriage assembly 50 approaches the uppermost end of the linear portion 66 of track assembly 40, the trunions 180 are brought into contact with slots 305 in cranks 300. The power assistance assembly is at the rest, or ready, position as depicted in FIG. 6 with pressure applied to power piston 345.

Trunion 180 enters slot 305 and exerts upward pressure on crank 300. This upward pressure urges tip beam 315 into clockwise motion, as seen from FIG. 6. This motion causes a hydraulic valve (not shown) to shift, diverting hydraulic fluid from motors 170 to the power piston 345. Simultaneously the motion brings yoke supports 335 down, which also moves yoke axis 620 downward and out of alignment with the other two axes 610, 630, thus allowing power piston 345 to expand to produce a clockwise torque about axis 610 to assist movement of the carriage assembly 50 over the curved portion 70 of guide rails 65. With the assistance of power piston 345, the carriage assembly 50 is advanced over the curved portion 70 of guide rails 65, thus upending the container held by gripping assembly 45 so that the contents of the container are emptied into the access area 20 of the collection tank 15. The final orientation of carriage assembly 50 is shown in phantom lines on FIG. 3. Carriage assembly 50 is brought back down the track assembly 40 by reversing the process while it is in the final position, that is, forcibly collapsing power piston 345 so that tip beam 315 is moved in a counterclockwise direction to exert a reverse force against the trunions 180 of carriage assembly 50.

While only a preferred embodiment has been illustrated and described, obvious modifications may be made within the scope of this invention and the following claims without substantially changing its functions. Accordingly, the scope of the invention should be determined not by the embodiments illustrated but by the appended claims and their legal equivalents.

The invention claimed is:

1. In a refuse collection system having a frame attached to the side of a refuse collection vehicle, the frame supporting an upwardly extending guide rail in a substantially vertical plane, the guide rail having a curved portion its top end, the system including a carriage mounted on the guide rail for reciprocal movement along its length and a gripping means secured to the carriage, whereby a container is securely gripped for vertical and inverted movement, an improvement comprising:

a. a rack comprised of a flat sheet with horizontal ridges impressed therein and spaced to mesh with teeth on the pinion gear, the rack positioned parallel to the guide rail and of substantially the same length as the guide rail;

b. a pinion gear mounted on the carriage, the pinion gear having a horizontally-oriented axis and having teeth engaging the rack for effecting reciprocal movement of the carriage along the guide rail, the gear urged into rotation by a motor mounted on the carriage means, the motor with its shaft in communication with the axis.

2. The apparatus described in claim 1, wherein the rack further comprises a plurality of horizontal bars along the curved portion of the guide rail, the bars spaced to mesh with teeth of the pinion gear as it traverses the curved portion.

3. The apparatus described in claim 1, wherein the pinion gear is axially mounted on the shaft of the motor.

4. A refuse collection apparatus for attachment to a vehicle for raising and lowering a container relative to said vehicle and for tipping said container when in a raised position to allow the contents of said container to fall by gravity into an elevated access area on a receiving tank mounted on said vehicle, the apparatus comprising:

a. a frame for attachment of said apparatus to said receiving tank;

b. a track assembly having a linear portion at its lower end and a curved portion at its upper end, said track assembly being supported by said frame;

c. a carriage assembly comprising a container grasping means, a power source, and a drive mechanism powered by said power source for self advancement of said carriage assembly along said track assembly; and d. a power assisting means aiding said power source on said carriage assembly in the traversal of said carriage assembly over said curved portion, controlling the speed of traversal of said carriage assembly over said curved portion, and upending said container held thereby.

5. The apparatus described in claim 4, wherein the drive assembly for self-advancement of said carriage assembly along the track assembly comprises a rack and a pinion, said rack extending parallel to and the length of said track assembly and said pinion contained in said carriage assembly.

6. The apparatus described in claim 4, wherein said frame is adapted to reciprocate transversely from said receiving tank, said frame being animated by a pair of pistons rigidly joined with respective first and second piston rods extending in opposite directions, said first piston rod connected to said frame, said second piston rod connected to said receiving tank.

7. An apparatus for lifting a container from a surface and emptying the contents thereof into an elevated dumping area, the apparatus comprising:

a. an elevating means with a lower end proximate with the surface, an upper end proximate with the dumping area, an inward side oriented towards the dumping area, and an outward side oriented away from the dumping area, the elevating means further having a linear portion extending from the lower end to terminate a distance from the lower end, and a curved portion extending from the termination of the linear portion to the upper end and curving in a direction towards the inward side, whereby the container is tipped into a dumping position to allow its contents to fall therefrom by force of gravity, the elevating means comprising:

(1) a guide means extending from the lower end to the upper end through the linear and curved portions and defining a path for reciprocal movement along the elevating means;

(2) a rack means following the path; and, (3) a carriage assembly positioned on the outer side for self-controlled, self-powered, and reciprocal movement along the path, the carriage assembly comprising one or more pinion gears mounted for rotational engagement with the rack means, one or more power means urging the gears into rotational movement, and an engagement means engaging the guide means to maintain the carriage assembly in close proximity with the rack means and for following the path defined by the guide means, whereby controlled movement of the carriage assembly is maintained between the lower and upper ends;

b. a gripping means mounted on the carriage assembly for selectively gripping and releasing the container; and c. a power assisting means for controlling and augmenting the power required for achieving the traversal of the carriage assembly through the curved portion and for controlling the speed of traversal of the carriage assemble over the curved portion.

8. The apparatus described in claim 7, wherein said power assisting means comprises:

a. a tip beam having a first end, a second end, and a horizontal first axis of rotation therebetween;

b. a crank means connected with said first end of said tip beam, said crank means having a slot to receive a trunion horizontally projecting from said carriage assembly as said carriage assembly moves upwardly on said guide means;

c. a yoke with a third end having a bight and with a fourth end having an associated horizontal second axis of rotation, said yoke being pivotally connected to said tip beam at said second axis located between said first axis and said second end of said tip beam; and, d. a piston having a fifth end and a sixth end, said fifth end fixedly connected to said bight on said third end of said yoke and said sixth end pivotally connected to said guide means at a third horizontal axis;

wherein assistance is given to said carriage assembly in traversing said curved portion as said carriage assembly moves upwardly, said power assisting means being configured in preparation to contact with said trunion on said carriage assembly by aligning said first axis, said second axis, and said third axis along a common centerline; said trunion initiating power assistance by engaging said slot of said crank to urge said tip beam into rotational movement about said first axis, thereby moving said second axis out of alignment with said first and third axes to allow forcible expansion of said piston against said third end of said yoke to assist rotational movement of said tip beam, said trunion being captured by said slot as said crank means rotates along with said first end of said tip beam and thereby applying upward force against said trunion, until said piston is fully extended and said carriage has moved to said upper end of said elevating means; and wherein assistance is given to said carriage assembly in moving said carriage assembly along said curved portion from said upper end of said elevating means back to said linear portion by forcibly removing pressure from said piston, thereby reversing the aforementioned activity.

9. The apparatus described in claim 7, herein the rack means, comprises a flat sheet with horizontal ridges impressed therein and spaced to mesh with teeth on the pinion gear.

10. The apparatus described in claim 7, wherein the rack means comprises:

a. a flat sheet having spaced horizontal ridges impressed therein along the linear portion of the path and spaced to mesh with teeth on the pinion gear; and b. a plurality of horizontal bars along the curved portion of the guide rail, the bars spaced to mesh with teeth of the pinion gear as it traverses the curved portion of the path.

11. The apparatus described in claim 7, wherein the rack means comprises a plurality of horizontal bars spaced along the length of the path so as to mesh with teeth of the pinion gear as it rotates.

12. A method of loading refuse in a container into a vehicle having an elevated refuse compartment with an access area, said method comprising:

a. providing an elevating assembly associated with said vehicle, said elevating assembly capable of being extended from said vehicle to bring a pair of gripping arms into proximity of said container;

b. gripping said container;

c. elevating said container in an upright orientation from the lower end of the elevating assembly;

d. inverting said container over said access area by moving said container in a curved path, under the control and aid of a power assisting means;

e. allowing the contents of said container to fall by gravity into said access area of said refuse compartment; and f. returning the emptied container to a predetermined position and releasing said container.

13. In a refuse collection system of a type having track assembly with a semicircular top end for inversion of a refuse container being carried by a self-powered carriage with gripping arms holding said container, said semicircular top end having an outer rim over which said self-powered carriage traverses, a power assistance apparatus comprising:

a. a crank with a slot for engaging a trunion on said carriage when said carriage begins its traversal of said semicircular top end;

b. a tip beam having a first pivot point coincident with a center of said semicircular top end, said tip beam having a first end and a second end, said crank rigidly attached to said first end;

c. a yoke assembly comprising a pair of yoke supports connected to said second end of said tip beam and extending towards said crank and a U-shaped yoke positioned for rotating movement therebetween, said yoke having a bight and a pair of open third ends, said yoke supports each having a fixed end and an open end with a second pivot point, said open third ends of said yoke pivotably attached at said second pivot points to allow the yoke to rotate about said pivot points and between the yoke supports without obstruction;

d. a piston having a fourth and fifth ends, said fourth end rigidly seated in said bight, said fifth end pivoting at a third pivot point immediately interior to said outer rim, said piston having a centerline disposed so that first, second, and third pivot points are coincident with said centerline prior to engagement of said trunion with said slot, said second pivot point being moved off of said centerline by said engagement of said trunion with said slot, said piston applying torque to said tip beam in the same direction as movement urged by engagement of said trunion by said slot, said piston expanding to its fullest extent so that said piston urges said carriage in its traversal of said semicircular top end and controls the speed of said carriage thereby.

14. In a refuse collection system for lifting a container containing refuse from a surface, delivering the container to an elevated collection area, and upending the container so that its contents falls by gravity into the collection area, the system comprising a guide rail defining a path from the surface to the collection area, a carriage mounted on the guide rail for reciprocal movement thereon, and a gripping means mounted on the carriage for securely gripping the container for vertical and inverted movement, an improvement comprising:

a. a rack positioned parallel to the guide rail and of substantially the same length as the guide rail;

b. a single elongate pinion gear mounted on the carriage, the pinion gear with teeth engaging the rack, the pinion gear with a horizontally-oriented axis each end of which coaxially communicates with a shaft of a motor mounted on the carriage, the two motors cooperatively urging the pinion gear into rotation thereby effecting reciprocal movement of the carriage along the guide rail.

15. The improvement described in claim 14, wherein the rack comprises a flat sheet with horizontal ridges impressed therein, the ridges spaced for meshed engagement with the teeth.

16. The improvement described in claim 14, wherein the rack comprises a plurality of horizontally oriented bars spaced for meshed engagement with the teeth.

17. The improvement described in claim 14, wherein the rack and guide rails comprise a curved portion proximately located at the collection area, whereby the curved portion causes the carriage traversing the curved portion to invert, thus allowing the contents of the container to fall into the collection area by action of gravity.

18. The improvement described in claim 17, further comprising a power assisting means regulating the speed by which the carriage traverses the curved portion and providing power to urge the carriage along the curved portion.

* * * * *